US007677240B2

(12) United States Patent
Gongwer

(10) Patent No.: US 7,677,240 B2
(45) Date of Patent: Mar. 16, 2010

(54) FOOD OVEN

(75) Inventor: Troy Gongwer, Wakarusa, IN (US)

(73) Assignee: Boss Products Inc., Wakarusa, IN (US)

( * ) Notice: Subject to any disclaimer, the term of this patent is extended or adjusted under 35 U.S.C. 154(b) by 1017 days.

(21) Appl. No.: 11/396,730

(22) Filed: Apr. 3, 2006

(65) Prior Publication Data

US 2007/0227525 A1 Oct. 4, 2007

(51) Int. Cl.
*F24B 1/08* (2006.01)

(52) U.S. Cl. ..... 126/273 R; 126/281; 126/369.3; 126/20.2

(58) Field of Classification Search ..... 126/273 R, 126/281, 369.1, 369.2, 369.3, 20.2, 20.1, 126/39 C
See application file for complete search history.

(56) References Cited

U.S. PATENT DOCUMENTS

| | | | | |
|---|---|---|---|---|
| 2,214,425 | A * | 9/1940 | McNamara | 126/20.2 |
| 4,453,457 | A | 6/1984 | Gongwer | |
| 4,599,938 | A | 7/1986 | Gongwer | |
| 4,600,596 | A | 7/1986 | Gongwer | |
| 4,947,741 | A | 8/1990 | Gongwer | |
| 4,986,174 | A | 1/1991 | Gongwer | |
| 5,076,258 | A | 12/1991 | Gongwer | |
| D334,687 | S | 4/1993 | Gongwer | |
| 5,205,208 | A | 4/1993 | Gongwer | |
| 5,542,345 | A | 8/1996 | Gongwer | |
| 5,816,137 | A | 10/1998 | Gongwer | |
| 6,119,586 | A | 9/2000 | Gongwer | |
| 6,250,211 | B1 | 6/2001 | Gongwer | |
| 2002/0029695 | A1 | 3/2002 | Gongwer | |

FOREIGN PATENT DOCUMENTS

| | | |
|---|---|---|
| CA | 1246410 | 12/1988 |
| CA | 1282659 | 4/1991 |
| CA | 2087050 | 1/1994 |
| CA | 2025359 | 2/2000 |

* cited by examiner

*Primary Examiner*—Alfred Basichas
(74) *Attorney, Agent, or Firm*—Barnes & Thornburg LLP

(57) ABSTRACT

An oven comprising a cooking chamber, a first tube having an inlet end associated with a heat source and defining an outlet opening disposed within the cooking chamber for delivering heat from the heat source through the outlet opening of the first tube to a first area of the cooking chamber, and a second tube having an end associated with the heat source and defining an outlet opening disposed within the cooking chamber for delivering heat from the heat source through the outlet opening of the second tube to a second area of the cooking chamber, the outlet opening of the second tube disposed above the outlet opening of the first tube. The oven may include additional tubes extending above the first and second tubes to deliver heat to other heights. The tubes may be aligned in a side-by-side manner and may be part of a tube assembly. The oven may further include oven racks disposed in the cooking chamber in a layered fashion corresponding to outlet openings of the tubes.

27 Claims, 10 Drawing Sheets

FOOD OVEN

The present disclosure relates to an oven for cooking food.

BACKGROUND

In the food service industry, when cooking a high volume of food, it typically is desirable to cook all of the food in a consistent manner. When serving food at indoor or outdoor parties, banquets or vending facilities, for example, a high volume of the same food often needs to be cooked substantially contemporaneously, meaning that it is desirable for all of the food to be cooked at or near the same temperature. It therefore is common in the foodservice industry to employ ovens having a chamber sufficiently large to receive a large number of food pans, which is typically accomplished with ovens having multiple layers of oven racks for supporting food pans. It is often difficult for such ovens to cook the large volume of food in a relatively consistent manner, however, because heat is not supplied to each layer at a consistent temperature.

SUMMARY

The present disclosure comprises one or more of the following features or combinations thereof disclosed herein or in the Detailed Description below.

The present disclosure relates to an oven for cooking food products comprising a cooking chamber, a heat source, a first tube having an inlet end associated with the heat source and defining an outlet opening disposed within the cooking chamber for delivering heat from the heat source through the outlet opening of the first tube to a first area of the cooking chamber, and a second tube having an inlet end associated with the heat source and defining an outlet opening disposed within the cooking chamber for delivering heat from the heat source through the outlet opening of the second tube to a second area of the cooking chamber, the outlet opening of the second tube disposed above the outlet opening of the first tube. The oven may include additional tubes extending above the first and second tubes to deliver heat to other locations above the outlet openings of the first and second tubes. The tubes may be aligned in a side-by-side manner and may be part of a tube assembly. The oven may further include oven racks disposed in the cooking chamber in a layered fashion corresponding to outlet openings of the tubes. The tube assembly may be disposed between pairs of oven racks. The oven may also include handles and moveable walls for moving pans disposed on the oven racks relative to the oven racks.

Additional features of the present disclosure will become apparent to those skilled in the art upon consideration of the following detailed description of illustrative embodiments of the disclosure.

BRIEF DESCRIPTION OF THE DRAWINGS

The detailed description particularly refers to the accompanying figure in which.

DETAILED DESCRIPTION

Figure 1:
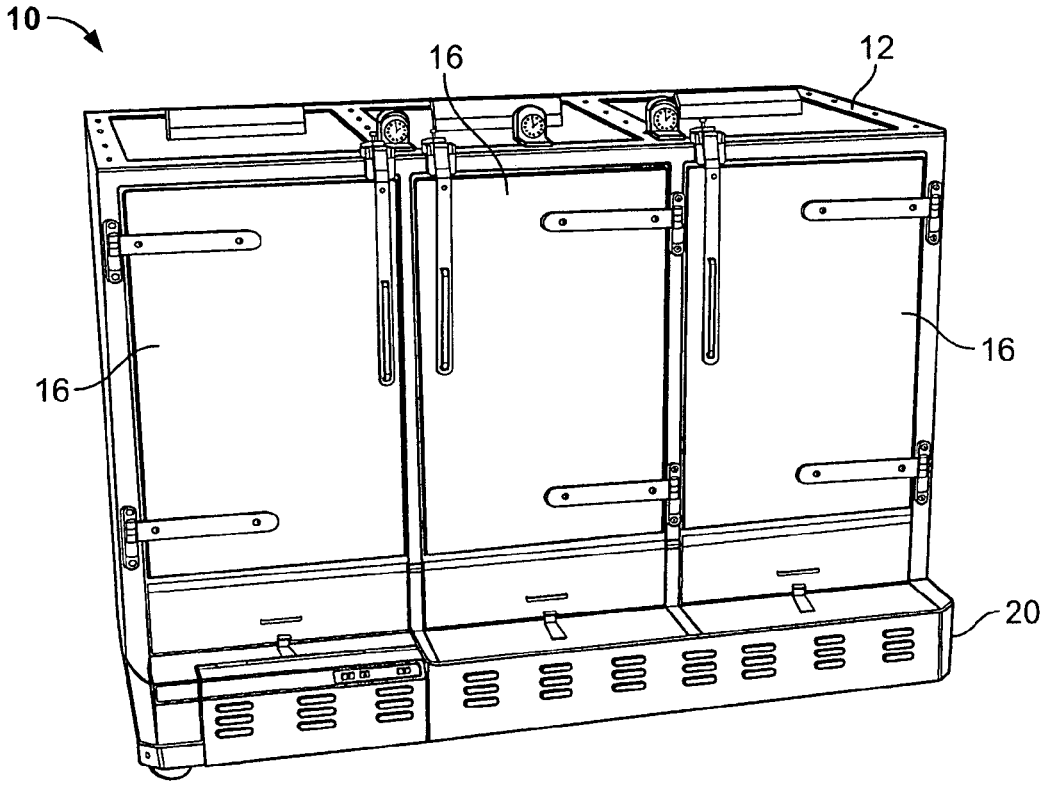
FIG. 1 is a front perspective view of an oven in accordance with an illustrated embodiment of the present disclosure.
Figure 2:
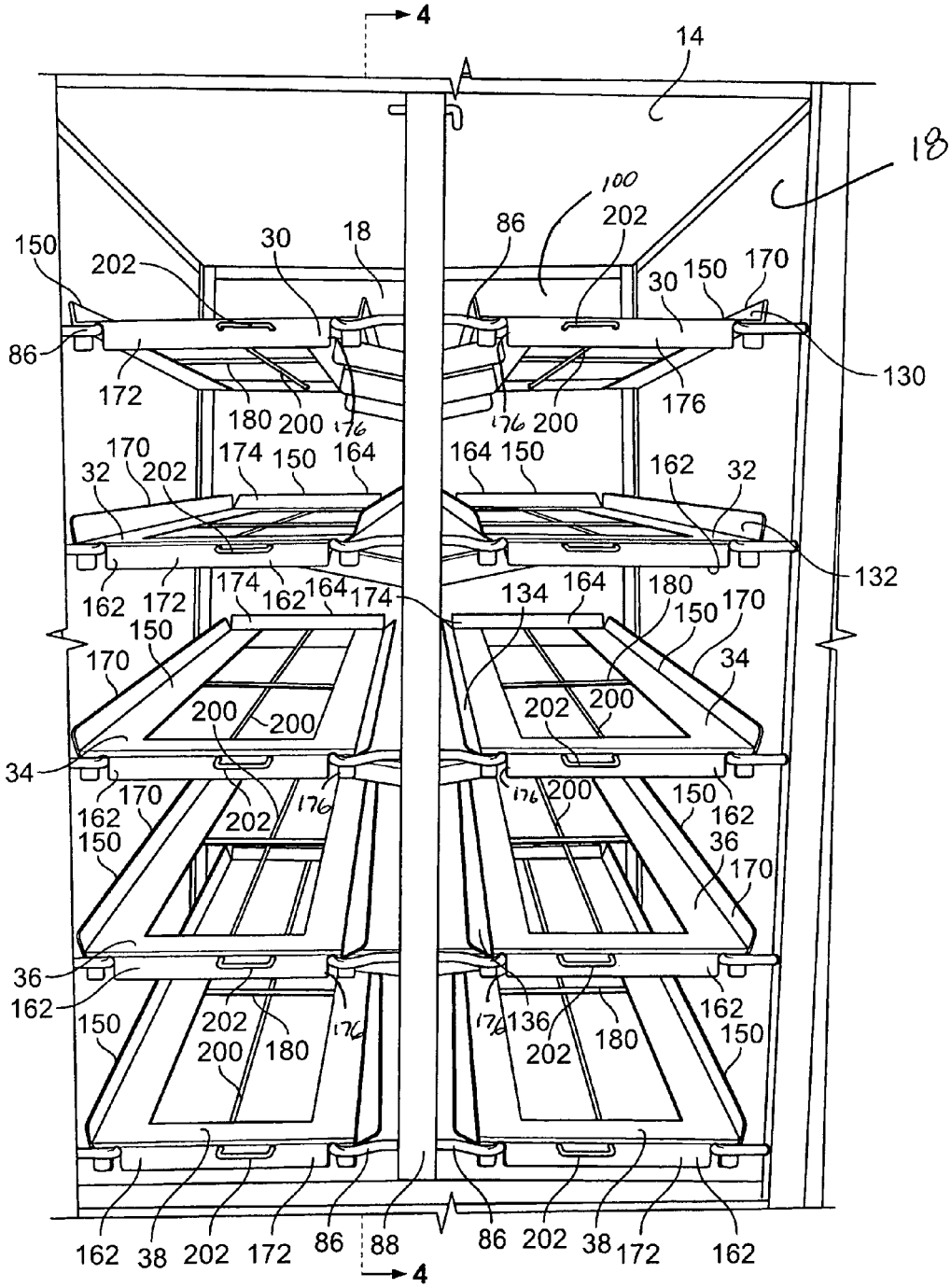
FIG. 2 is a front partial and broken portion view of a portion of the oven of FIG. 1 with a corresponding oven door in an open position, illustrating the inside of that portion of the oven.
Figure 3:
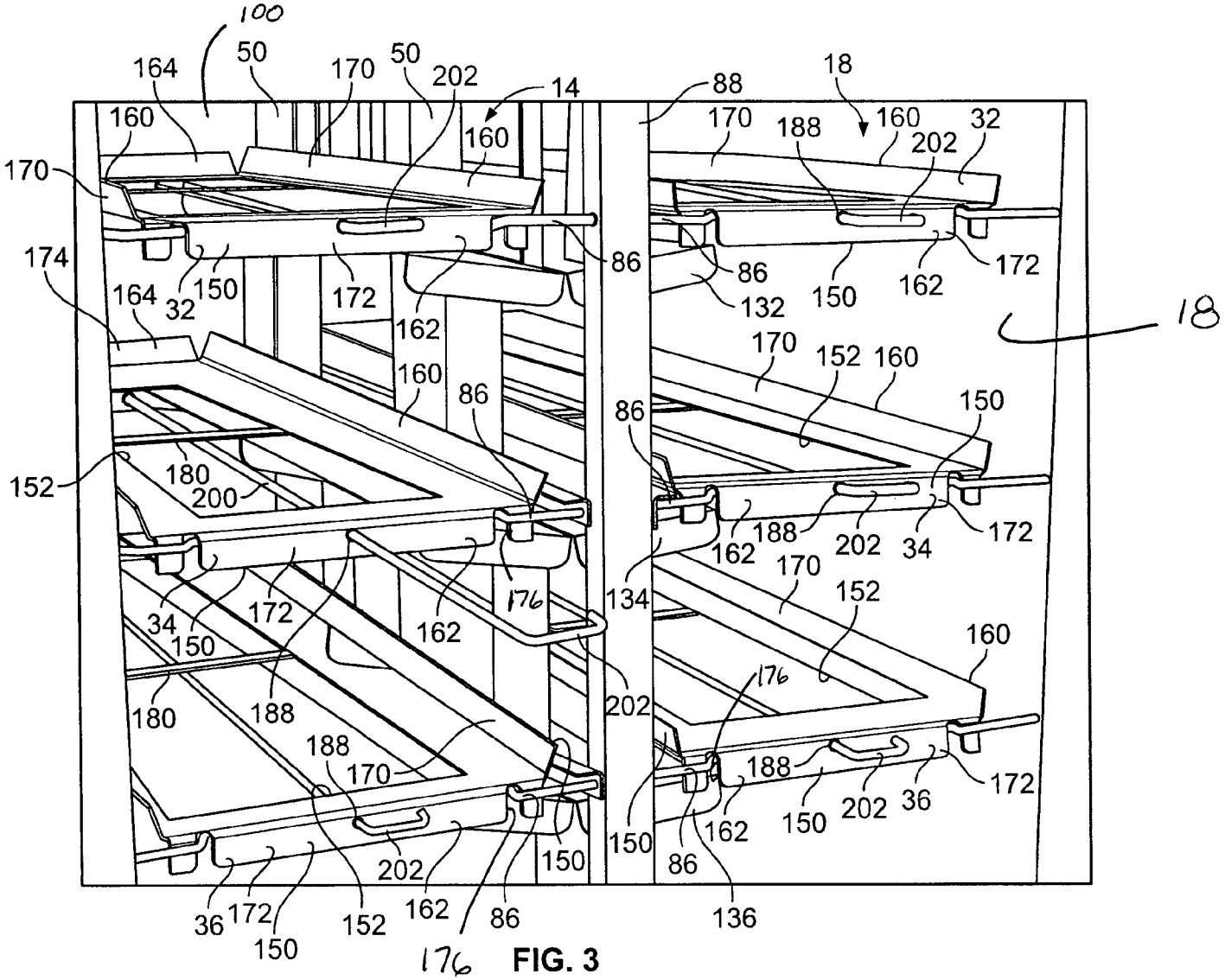
FIG. 3 is a front partial perspective and broken view of a portion of the oven of FIG. 1 with the corresponding oven door in an open position, illustrating the inside of that portion of the oven.
Figure 4:
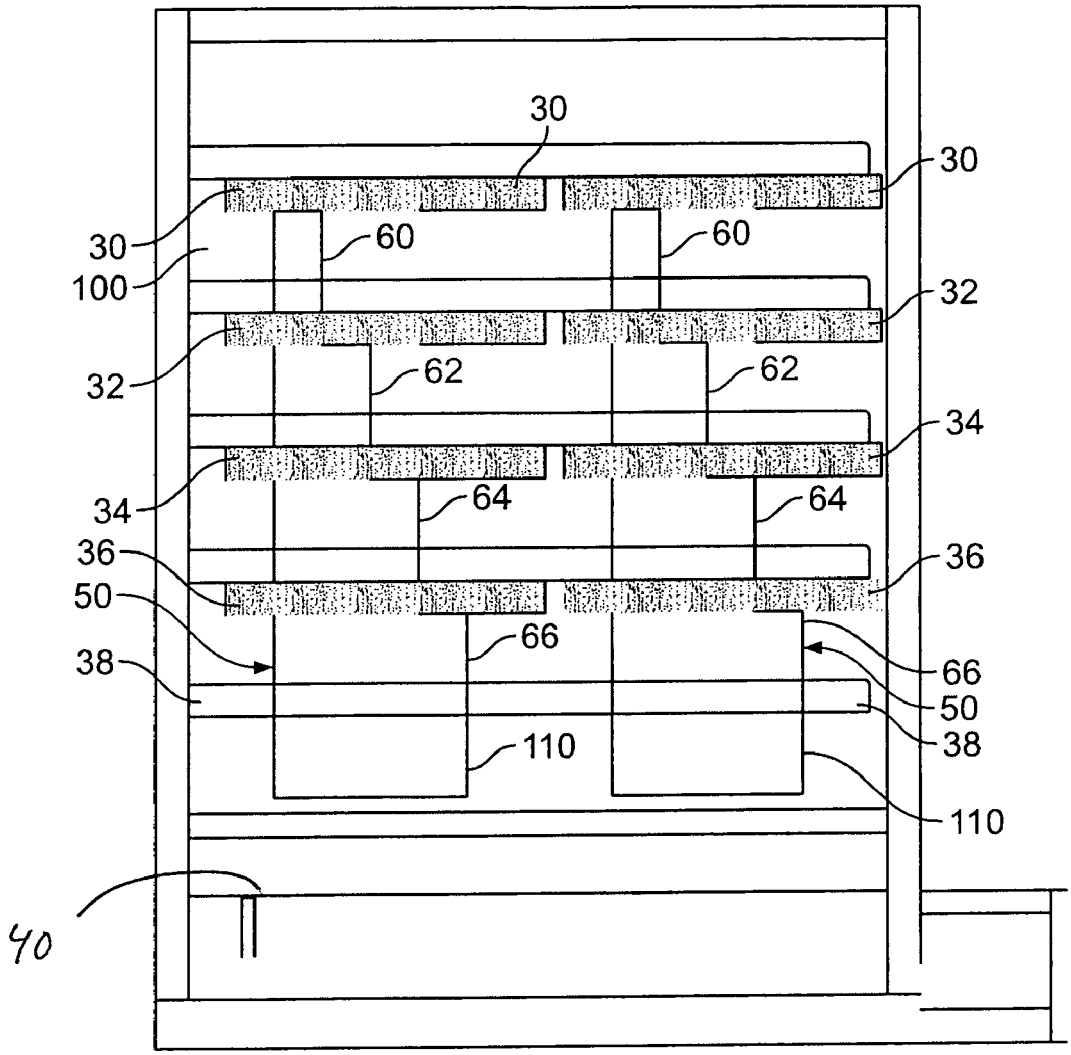
FIG. 4 is a side view, schematic in nature, taken along lines 4-4 of FIG. 2; illustrating a pair of the tube assemblies of the oven of FIG. 1.
Figure 5:
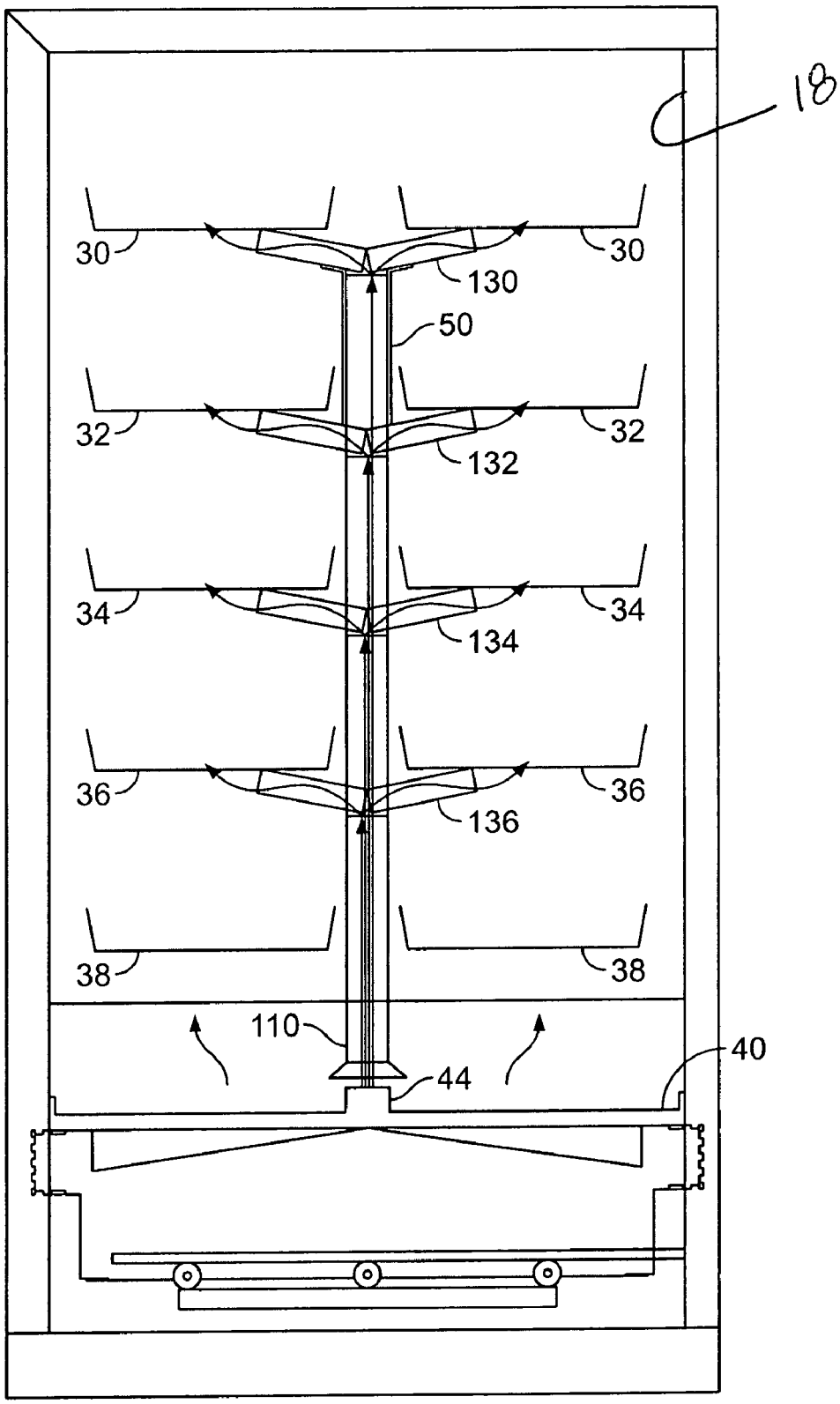
FIG. 5 is a front view, schematic in nature, of the front of one of the tube assemblies of FIG. 4.
Figure 6:
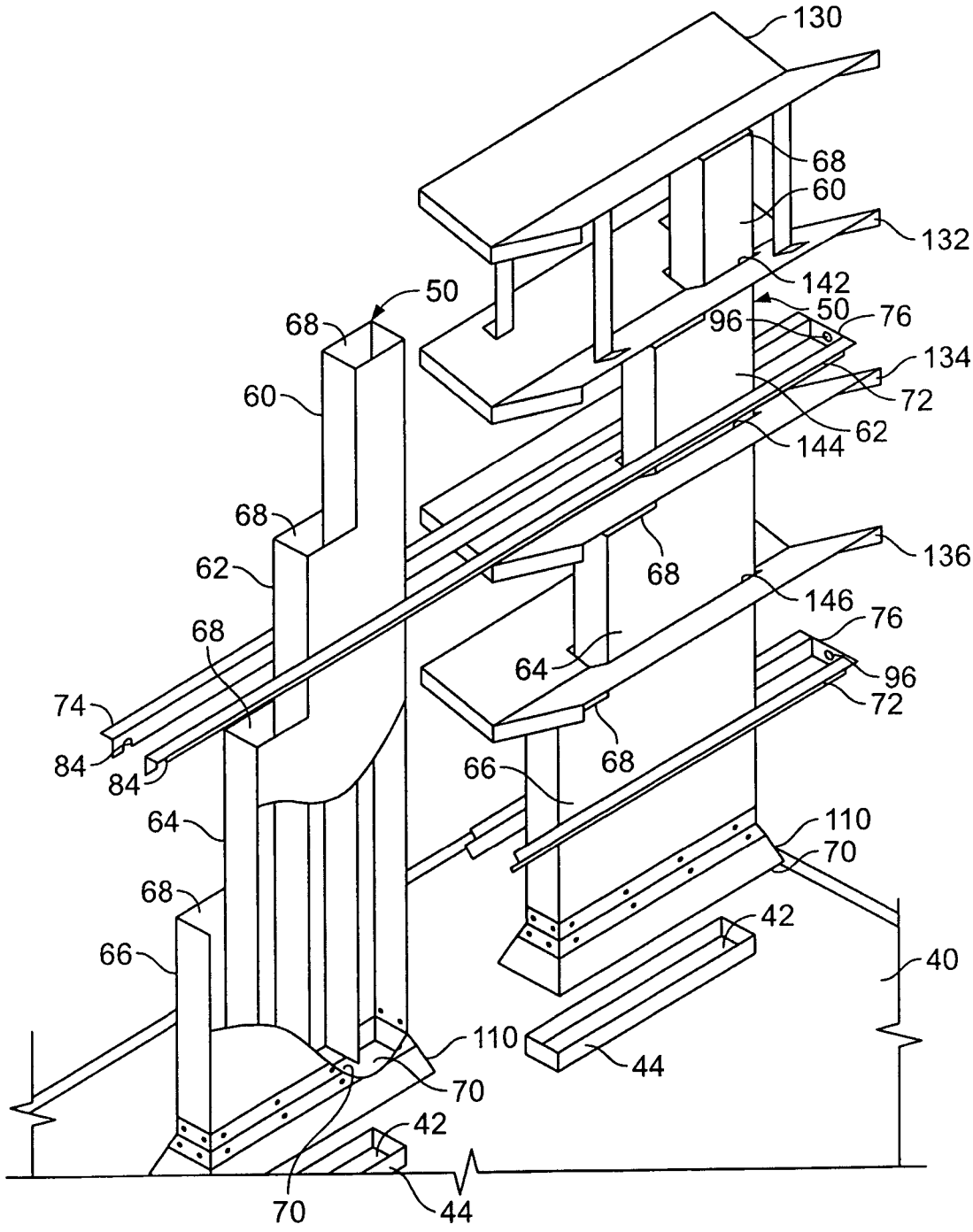
FIG. 6 is a partial and broken perspective assembly view, schematic in nature, illustrating the pair of tower assemblies of FIG. 4 and components for supporting the pair of tower assemblies.
Figure 7:
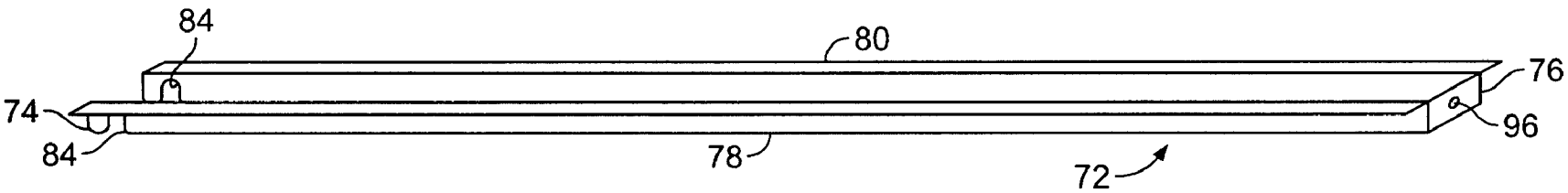
FIG. 7 is a perspective view of one of the mounting brackets of the oven of FIG. 1.
Figure 8:
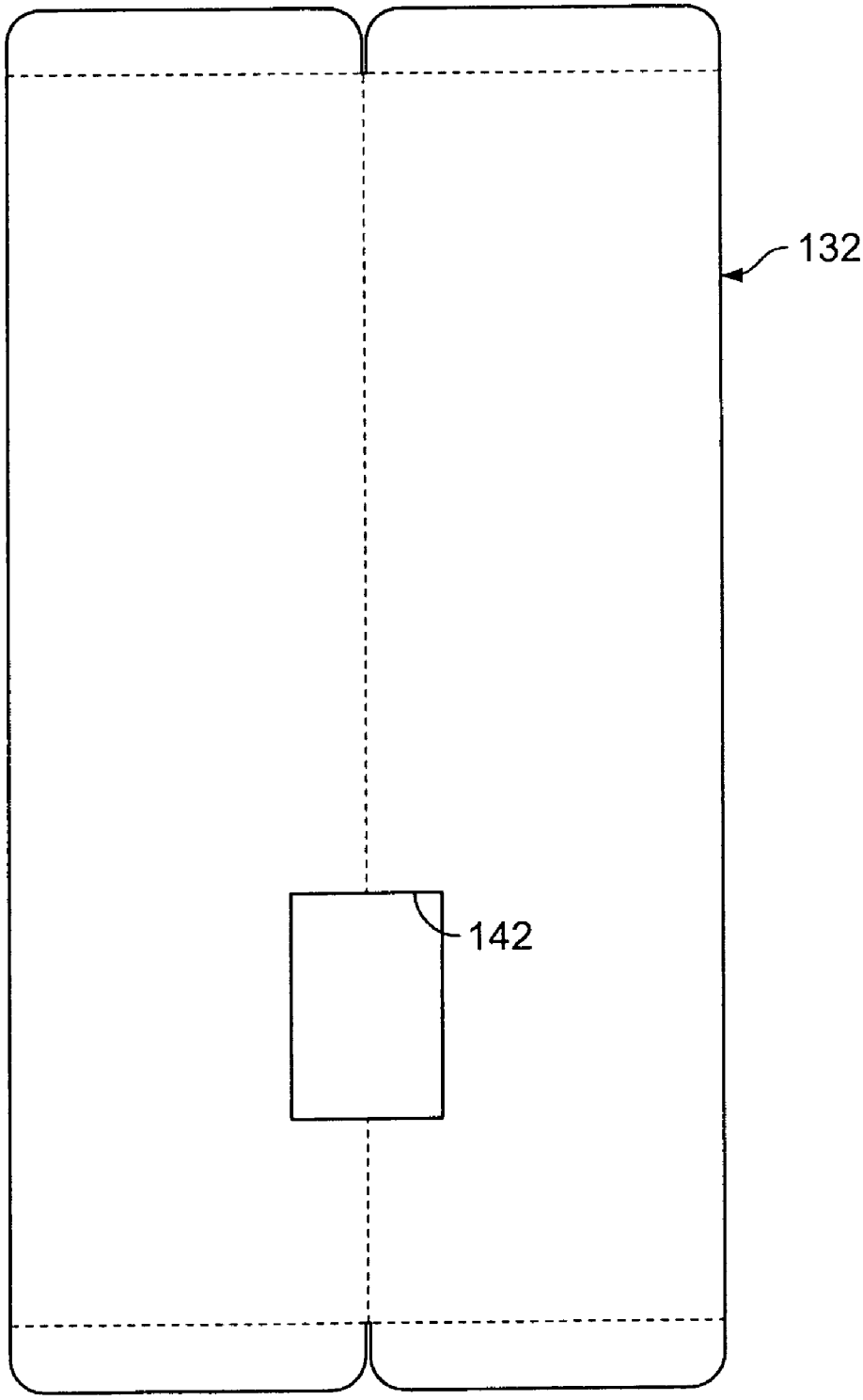
FIG. 8 is a top view of one of the heat deflectors of the oven of FIG. 1.
Figure 9:
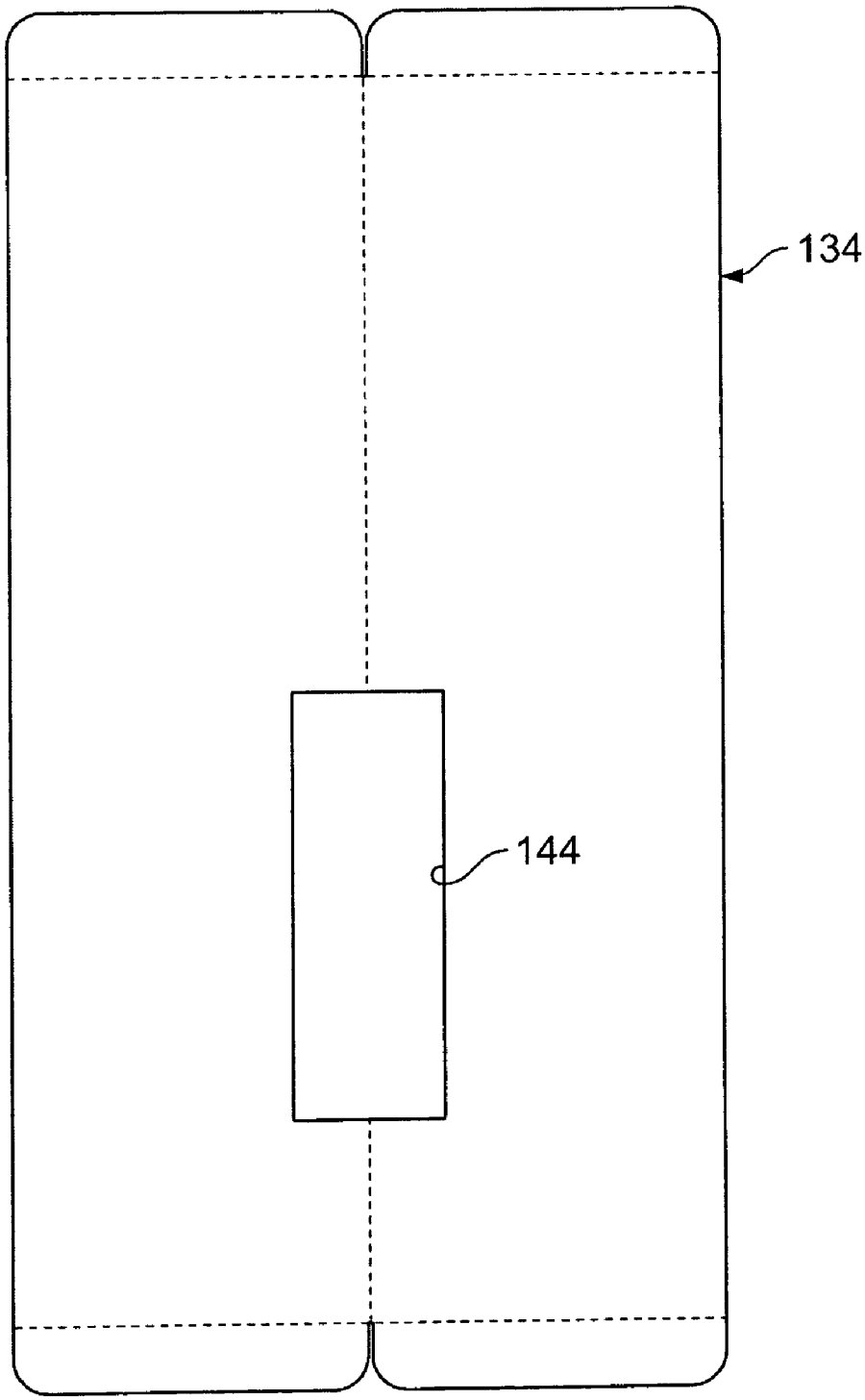
FIG. 9 is a top view of an other one of the heat deflectors of the oven of FIG. 1.

While the present disclosure may be susceptible to embodiment in different forms, there is shown in the drawings and herein will be described in detail, embodiments with the understanding that the present description is to be considered an exemplification of the principles of the disclosure and is not intended to limit the disclosure to the details of construction and the number and arrangements of components set forth in the following description or illustrated in the drawings.

The present disclosure is directed to an oven for cooking food. The oven may have any suitable external and internal configuration. The oven also may have any suitable number and construction of doors or other suitable access means, and may be heated by any suitable means, including, electric, gas, charcoal, etc.

FIGS. 1-10 illustrate an oven 10 for cooking food in accordance with an embodiment of the present disclosure. The oven 10 comprises generally a housing 12 defining a cooking chamber 14 and three oven doors 16 enclosing the cooking chamber 14. The three doors 16 define three cooking areas 18.

The oven 10 includes a base 20 comprising an electronic heating and heating control system. The source of the heat and the manner of controlling the heat can have any suitable form. The heat source may, for example, be in the form of a standard stainless steel ribbon burner or may be any other suitable heat source. The manner of controlling the heat can be in the form of a millivolt system and can also include LED's or other indicator lights, or may be any other suitable form.

The oven 10 includes five rows of oven racks 30, 32, 34, 36 and 38 within the cooking chamber 14. Each row of oven racks 30, 32, 34, 36 and 38 includes three pairs of oven racks 30, 32, 34, 36 and 38, respectively, so that each row of oven racks comprises six oven racks across the three cooking areas 18. Additionally, with three oven doors 16, the oven 10 is configured so that each oven door 16 provides access to the corresponding one of the cooking area 18 which comprises five vertically-aligned pairs of oven racks 30, 32, 34, 36 and 38. The oven area 10 also includes three heat plates 40, each corresponding to one of the cooking areas 18. Each heat plate defines a square aperture 42 and includes a flange 44 as described hereafter.

The illustrated oven 10 also comprises a pair of tube assemblies 50 in each cooking area 18 extending vertically between corresponding pairs of oven racks 30, 32, 34, 36 and 38 in each cooking area 18 for delivering heat to various heights within the cooking chamber 14. Each tube assembly 50 comprises four tubes aligned in a side-by-side manner extending to different heights. Each tube 60, 62, 64 and 66 includes an outlet end 68 and an inlet end 70. The tube assemblies 50 and the tubes 60, 62, 64 and 66 may be constructed in any suitable manner and have any suitable configuration. Each of the illustrated tubes 60, 62, 64 and 66, for example, has a rectangular cross section, but each may have any other suitable cross section in accordance with other embodiments.

In the illustrated embodiment, in each tube assembly 50, the tube 60 extends to just below a corresponding pair of the oven racks 30 to deliver heat to an area below the corresponding pair of the oven racks 30 to heat food on the oven racks 30; the tube 62 extends to just below a corresponding pair of the oven racks 32 to deliver heat to an area just below the corresponding pair of the oven racks 32 to heat food on the oven racks 32; the tube 64 extends to just below a corresponding pair of the oven racks 34 to deliver heat to an area just below corresponding pair of the oven racks 34 to heat food on the oven racks 34; and the tube 66 extends to just below a corresponding pair of the oven racks 66 to deliver heat to an area just below the corresponding pair of the oven racks 36 to heat food on the oven racks 36. Heat is delivered to just below each pair of the oven racks 38 from a corresponding heat plate 40 to heat food on the oven racks 38.

The tube assemblies 50 can be secured or otherwise supported in any suitable manner. In the illustrated embodiment, for example, the tube assemblies 50 are suspended above the heat plates 40, and a pair of mounting brackets 72 are included for supporting a corresponding pair of the tube assemblies 50. Each mounting bracket 72 includes forward and rear ends 74 and 76, and a pair of opposed sides 78 and 80 having inverted L-shaped cross sections. The forward end 74 is open and each of the sides 78 and 80 defines a U-shaped opening 84 for receiving a hook-shaped rod 86 secured to the oven frame support 88. The rear end 76 defines a hole 96 to receive or otherwise engage a pin (not shown) secured to the rear wall 100 of the oven 10. The brackets 72 are supported by the rods 86 and the pins.

The illustrated tube assemblies 50 are supported in such a manner that the bottom ends 110 of the tube assemblies are suspended above the heat plate 40 in a lower area of the oven 10. Heat may be directed from the heat source toward the bottom ends 110 of the tube assemblies 50 in any suitable manner. In the illustrated assembly, a flange (not shown) and a skirt (not shown) extend from the bottom 110 of each tube assembly 50 to the flange 44, enclosing the gap between the flange and the bottom 110 of each tube assembly to direct the heat towards and into the bottom ends of the tube assemblies 50. The skirt may, for example, be in the form of a high temperature cloth pop riveted or otherwise secured to the tube assembly 50 adjacent the bottom 110 of the tube assembly, hanging down and around the corresponding flange 44.

Figure 10:
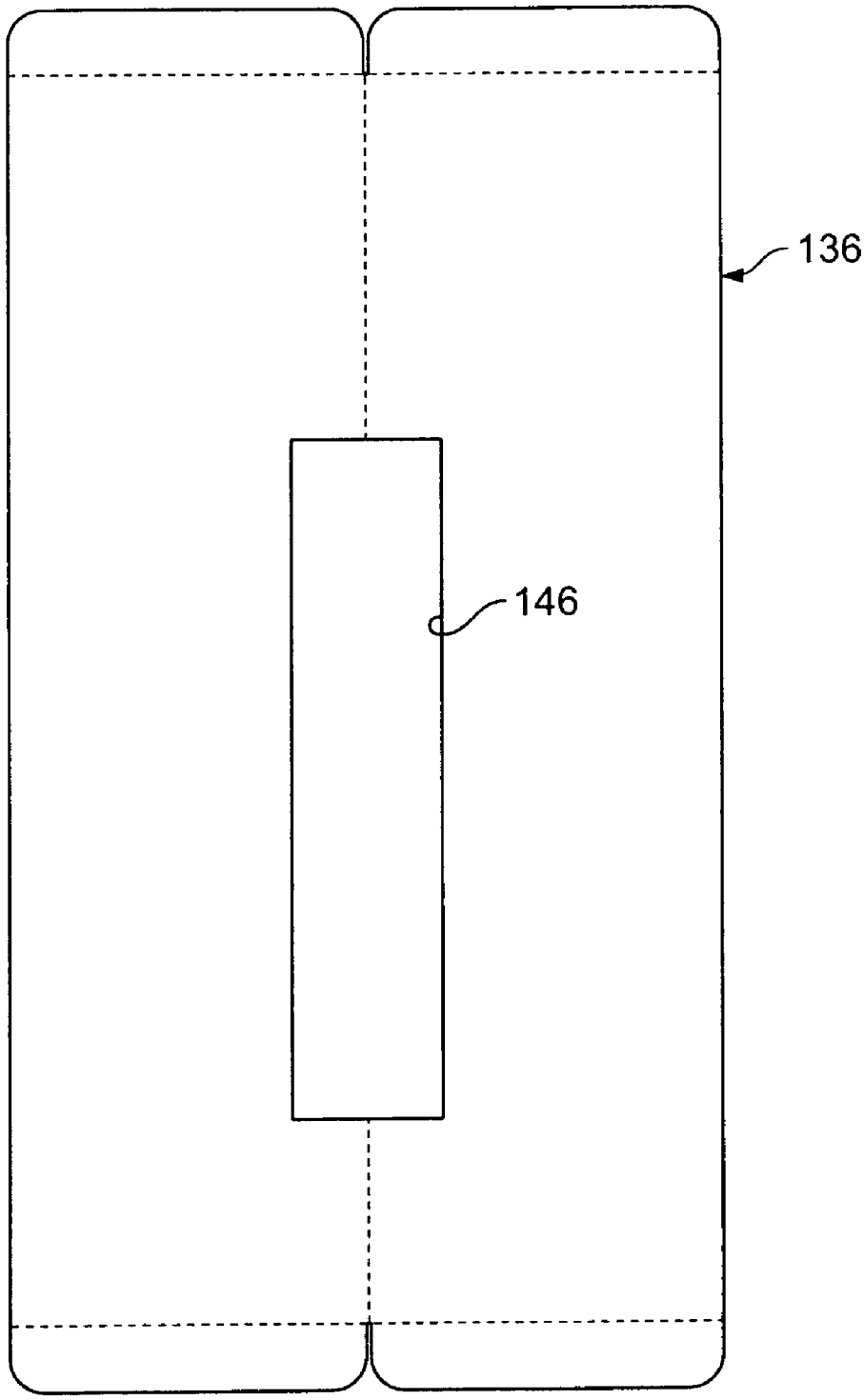
FIG. 10 is a top view of an other one of the heat deflectors of the oven of FIG. 1.

The illustrated oven 10 also includes heat deflectors 130, 132, 134 and 136 adjacent the outlet ends of the tubes 60, 62, 64 and 66 to deflect heat laterally underneath each oven rack of each pair of oven racks 30, 32, 34 and 36. The illustrated heat deflectors 130, 132, 134 and 136 are generally V-shaped, with each wing of the V extending from the vertex at a slight upward angle of roughly 10-20 degrees. Deflectors 132, 134 and 136 of each tube assembly define openings 142, 144 and 146 to receive the tube assemblies 50. Opening 142 is sized to receive the tube 60 (FIG. 8); opening 144 is sized to receive tubes 60 and 62 (FIG. 9); and opening 146 is sized to receive the tubes 60, 62 and 64 (FIG. 10). The deflector 130 does not define an opening for receiving any of the tubes 60, 62, 64 and 66. The deflectors 130, 132, 134 and 136 may be supported by the tube assemblies in any suitable manner. In the illustrated embodiment, for example, the deflectors 132, 134 and 136 are spot welded to the tube assembly, and the deflector 130 is supported by support members spot welded to the deflectors.

The oven racks 30, 32, 34, 36 and 38 may have any size and configuration and may or may not be slidable to facilitate easy placement of pans in the oven 10 and removal therefrom. In the illustrated embodiment, for example, each oven rack 30, 32, 34, 36 and 38 is configured to hold two hotel-sized pans or four half hotel-sized pans. Each of the illustrated oven racks 30, 32, 34, 36 and 38 is generally rectangular and includes a peripheral rim 150 defining a center opening 152. The peripheral rim 150 includes a pair of sides 160, and a front 162 and a back 164. Each of the sides 160 of the rim 150 includes a pan guide 170 along extending along the length of the rack for positioning the pans on the rack. The front 162 and back 164 of the rim 150 includes a downward extending lip 172, and the back 164 includes a pan guide 174.

The oven racks 30, 32, 34, 36 and 38 may be secured and supported within the oven 10 in any suitable manner. In the illustrated embodiment, for example, the pair of hook-shaped rods 86 secures the front of each rack to the oven frame support 88, and a plurality of pins (not shown) secure the rear of each rack to the rear wall 100 of the oven 10. Each hook-shaped rod 86 extends laterally from the oven support 88 to the lip of the front rim, and bends 90 degrees towards the rear of the oven 10 extending through a slot 176 at the lip of the front rim. The rear of each rack 30, 32, 34, 36 and 38 defines inverted holes to receive the pins (not shown) secured to the rear wall of the oven 10. Each rack 30, 32, 34, 36 and 38 also includes a laterally-extending support member 180 secured to the bottom of each of the sides of the rim for providing additional support for the pans.

Additionally, each rack 30, 32, 34, 36 and 38 may include a mechanism for moving the rear pan relative to the rack to provide easy access to the rear pan for removal. In the illustrated mechanism, for example, the wall 174 is slidable for engaging and moving the rear of the rear pan, and a rod 200 is secured to the slidable wall 174 extending to the front rim. The rod 200 extends though an aperture 188 defined by the front rim and terminates in a handle 202 on the opposite side of the front rim. The rod 200 is secured to the back of the slidable wall 174 near the center, and extends along the center of the rack to the center of the front rim. Pulling the handle 202 relative to the front rim causes the rod 200 to move forward, pulling the slidable wall 174 forward. When a rear pan is on the rack, the slidable wall 174 pushes the rear pan forward for easy access to the rear pan from outside the oven 10.

The foregoing description is for exemplary purposes only and is not intended to limit the scope of protection accorded this disclosure. The scope of protection is to be measured by the following claims, which should be interpreted as broadly as the contribution permits.

What is claimed:

1. An oven for cooking food products comprising:

(a) a cooking chamber having a lower area;

(b) a heat source disposed within the lower area of the cooking chamber;

(c) a first tube having an inlet end associated with the heat source and disposed within the lower area and defining an outlet opening disposed within the cooking chamber for delivering heat from the heat source through the outlet opening of the first tube to a first area of the cooking chamber, the first tube having a length extending substantially vertically from the lower area to the outlet opening of the first tube for delivering heat from the heat source through the outlet opening of the first tube; and (d) a second tube having an inlet end associated with the heat source and disposed within the lower area and defining an outlet opening disposed within the cooking chamber for delivering heat from the heat source through the outlet opening of the second tube to a second area of the cooking chamber, the outlet opening of the second tube disposed above the outlet opening of the first tube, the second tube having a length extending substantially vertically from the lower area to the outlet opening of the second tube for delivering heat from the heat source through the outlet opening of the second tube, the length of the second tube being greater than the length of the first tube.

2. The oven of claim 1 further comprising a first oven rack and a second oven rack disposed above the first oven rack, the first oven rack disposed below the outlet opening of the second tube and above the outlet opening of the first tube and the second oven rack disposed above the outlet opening of the second tube.

3. The oven of claim 2 further comprising a first handle and a first moveable wall moveable relative to the first oven rack for moving a pan disposed on the first oven rack relative to the first oven rack, and a second handle and a second moveable wall moveable relative to the second oven rack for moving a pan disposed on the second oven rack relative to the second oven rack.

4. The oven of claim 2 further comprising a heat deflector adjacent the outlet end of the first tube and positioned to deflect heat laterally underneath the first oven rack and a heat deflector adjacent the outlet end of the second tube and positioned to deflect heat laterally underneath the second oven rack.

5. The oven of claim 4 wherein each heat deflector is generally V-shaped, with each wing of the V extending from the vertex at a slight upward angle of about 10-20 degrees.

6. The oven of claim 1 further comprising a pair of first and second oven racks disposed within the cooking chamber, the pair of first oven racks disposed below the outlet opening of the second tube and above the outlet opening of the first tube and the pair of second oven racks disposed above the pair of first oven racks and above the outlet opening of the second tube.

7. The oven of claim 6 wherein the second tube extends between the pair of first oven racks.

8. The oven of claim 1 wherein the first and second tubes are aligned in a side-by-side manner.

9. The oven of claim 1 wherein the first tube includes an outlet end defining the outlet opening of the first tube and the second tube includes an outlet end defining the outlet opening of the second tube.

10. The oven of claim 1 further comprising a third tube having an inlet end associated with the heat source and defining an outlet opening disposed within the cooking chamber for delivering heat from the heat source through the outlet opening of the third tube to a third area of the cooking chamber, the outlet opening of the third tube disposed above the outlet openings of the first and second tubes.

11. The oven of claim 10 further comprising first, second and third oven racks disposed within the cooking chamber, the first oven rack disposed above the outlet opening of the first tube, the second oven rack disposed above the first rack and above the outlet opening of the second tube, and the third oven rack disposed above the second rack and above the outlet opening of the third tube.

12. The oven of claim 10 further comprising a pair of first oven racks, a pair of second oven racks and a pair of third oven racks disposed within the cooking chamber, the pair of second oven racks disposed above the pair of first oven racks, and the pair of third oven racks disposed above the pair of second oven racks, the pair of first oven racks disposed above the outlet opening of the first tube, the pair of second oven racks disposed above the outlet opening of the second tube, and the pair of third oven racks disposed above the outlet opening of the third tube.

13. The oven of claim 12 wherein the second tube extends between the pair of first oven racks and the third tube extends between the pair of first oven racks and between the pair of second oven racks.

14. The oven of claim 1 wherein the first and second tubes are disposed within the cooking chamber.

15. The oven of claim 1 further comprising a skirt extending in a gap between the inlet end of the first tube and the heat source whereby the skirt directs heat from the heat source towards and into the inlet end of the first tube.

16. The oven of claim 15 wherein the skirt is made of a high temperature cloth.

17. An oven for cooking food products comprising:

(a) a cooking chamber having a first area, a second area disposed above the first area and a lower area disposed below the first and second areas;

(b) a heat source disposed within the lower area of the cooking chamber;

(c) a first tube having an inlet end associated with the heat source and disposed within the lower area of the cooking chamber and an outlet end disposed within the first area of the cooking chamber for delivering heat from the heat source through the outlet end of the first tube to the first area of the cooking chamber, the first tube having a length extending substantially vertically from the inlet end to the outlet end; and (d) a second tube having an inlet end associated with the heat source and disposed within the lower area of the cooking chamber and an outlet end disposed within the second area of the cooking chamber for delivering heat from the heat source through the outlet end of the second tube to the second area of the cooking chamber, the second tube having a length extending substantially vertically from the inlet end to the outlet end, the length of the second tube being greater than the length of the first tube.

18. The oven of claim 17 further comprising first and second oven racks positioned within the cooking chamber, the second oven rack positioned above the first oven rack.

19. The oven of claim 17 wherein the first and second tubes are aligned in a side-by-side manner.

20. The oven of claim 17 further comprising a third tube having an inlet end associated with the heat source and an outlet end disposed within the cooking chamber for delivering heat from the heat source through the outlet end of the third tube to a third area of the cooking chamber, the third tube having a length extending from the inlet end to the outlet end, the length of the third tube being greater than the lengths of the first and second tubes.

21. The oven of claim 20 wherein the first, second and third tubes are aligned in a side-by-side manner.

22. The oven of claim 20 further comprising a first oven rack disposed within the cooking chamber above the outlet end of the first tube, a second oven rack disposed within the cooking chamber above the outlet end of the second tube, and a third oven rack disposed within the cooking chamber above the outlet end of the third tube.

23. An oven for cooking of food products comprising:

(a) a cooking chamber having a lower area;

(b) a source for providing heat disposed within the lower area;

(c) a pair of first oven racks disposed in the cooking chamber for supporting food product disposed above the heat source;

(d) a pair of second oven racks disposed in the cooking chamber for supporting food product, the pair of second oven racks being disposed above the heat source and above the pair of first oven racks;

(e) a first tube disposed in the cooking chamber, the first tube having an inlet end associated with the heat source and disposed within the lower area and defining an outlet opening for delivering heat for cooking food product on the pair of first oven racks, the first tube extending substantially vertically from the inlet end to the outlet opening of the first tube; and (f) a second tube disposed in the cooking chamber having an inlet end associated with the heat source and disposed within the lower area and defining an outlet opening for delivering heat from the heat source for cooking food product on the pair of second oven racks, the outlet opening of the second tube being disposed above the outlet opening of the first tube, the second tube extending substantially vertically from the inlet end to the outlet opening of the second tube and extending above the outlet opening of the first tube.

24. The oven of claim 23 further comprising:

(a) a pair of third oven racks disposed in the cooking chamber for supporting food product, the pair of third oven racks being disposed above the pair of second oven racks; and (b) a third tube disposed within the cooking chamber having an inlet end suspended above the heat source and defining an outlet opening for delivering heat from the heat source for cooking food product on the pair of third oven racks, the outlet opening of the third tube being disposed above the outlet opening of the first and second tubes.

25. The oven of claim 24 further wherein the first, second and third tubes are aligned in a side-by-side manner.

26. An oven for cooking of food products comprising:

(a) a cooking chamber having a lower area;

(b) a heat source disposed within lower end of the cooking chamber;

(c) a pair of first oven racks disposed in the cooking chamber for supporting food product disposed above the lower area;

(d) a pair of second oven racks disposed in the cooking chamber for supporting food product, the pair of second oven racks being disposed above the lower area and above the pair of first oven racks;

(e) a pair of third oven racks disposed in the cooking chamber for supporting food product, the pair of third oven racks being disposed above the lower area and above the pairs of first and second oven racks; and (e) a tube assembly disposed between the pairs of first, second and third oven racks comprising first, second and third tubes disposed in the cooking chamber extending substantially vertically and aligned in a side-by-side manner, each of the first, second and third tubes including an inlet end associated with the heat source and disposed within the lower area and an outlet end, the outlet end of the third tube being disposed above the outlet ends of the first and second tubes and the outlet end of the second tube being disposed above the outlet opening of the first tube, the first tube for delivering heat from the heat source for cooking food product on the pair of first oven racks, the second tube for delivering heat from the heat source for cooking food product on the pair of second oven racks, and the third tube for delivering heat from the heat source for cooking food product on the pair of third oven racks.

27. The oven of claim 26 further comprising a plurality of handles and moveable walls associated with the first, second and third oven racks, one handle and one moveable wall associated with and moveable relative to a corresponding one of the first, second and third oven racks for moving a corresponding pan disposed on the corresponding one of the first, second and third oven racks.

* * * * *